US005959645A

United States Patent [19]

Gondek

[11] Patent Number: 5,959,645

[45] Date of Patent: Sep. 28, 1999

[54] METHOD OF COLOR INK JET PRINTING ON GLOSSY MEDIA

[75] Inventor: Jay S. Gondek, Camas, Wash.

[73] Assignee: Hewlett-Packard Company, Palo Alto, Calif.

[21] Appl. No.: 08/396,812

[22] Filed: Mar. 2, 1995

[51] Int. Cl.[6] ..... B41J 2/21; B41J 2/145; B41J 2/15

[52] U.S. Cl. ..... 347/43; 347/40

[58] Field of Search ..... 347/43, 40; 358/458

[56] References Cited

U.S. PATENT DOCUMENTS

| | | | |
|---|---|---|---|
| 4,596,993 | 6/1986 | Erlichman | 347/251 |
| 4,959,790 | 9/1990 | Morgan | 364/518 |
| 5,107,346 | 4/1992 | Bowers et al. | 358/447 |
| 5,339,171 | 8/1994 | Fujisawa et al. | 358/458 |
| 5,428,377 | 6/1995 | Stoffel et al. | 347/15 |
| 5,600,353 | 2/1997 | Hickman et al. | 347/43 |

*Primary Examiner*—N. Le
*Assistant Examiner*—Thinh Nguyen

[57] ABSTRACT

A method of processing print data by scanning the print data to determine a black density level and a color density level. A fortification function in which color density varies with respect to black density is applied, and if the color density level is less than a predetermined value based on the fortification function at the given black density level, the color density level is increased to the predetermined value. This serves to ensure that black, dark gray, and dark muted color areas are properly fortified to prevent halo image defects. The method of processing may be performed in conjunction with the process of printing by an ink jet printer, and the fortification function may provide a color density of zero below a first threshold, an increasing density up to a second threshold, and a constant density above the second threshold.

17 Claims, 4 Drawing Sheets

FIG. 2
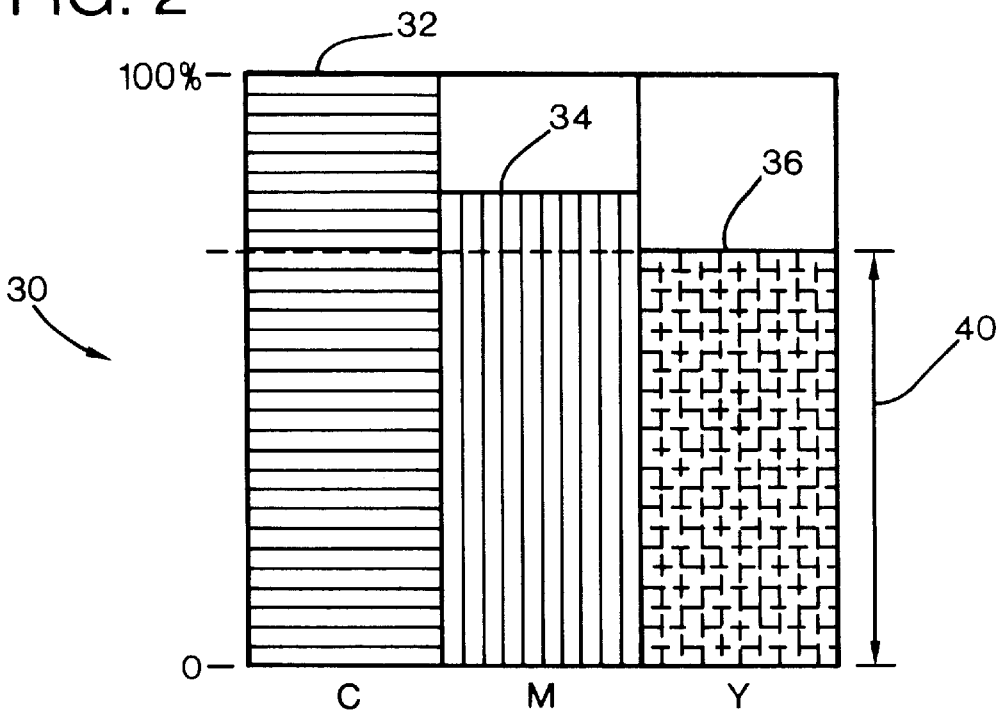
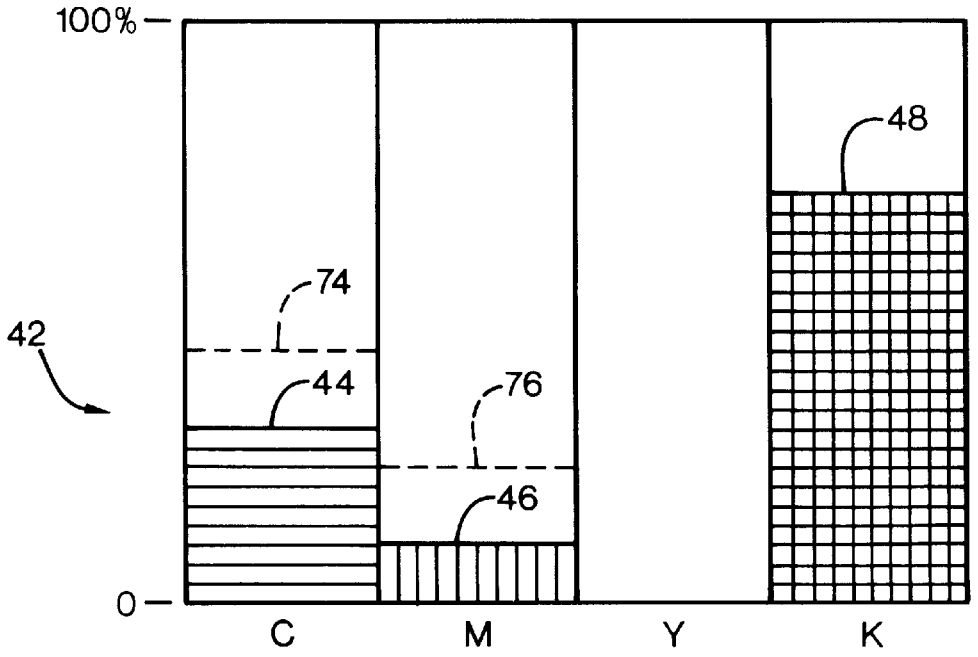
FIG. 3

METHOD OF COLOR INK JET PRINTING ON GLOSSY MEDIA

FIELD OF THE INVENTION

This invention relates to ink jet printing, and more particularly to ink jet printing using color and black inks.

BACKGROUND AND SUMMARY OF THE INVENTION

Ink jet printing mechanisms use pens that shoot droplets of colorant onto a printable surface to generate an image. Such mechanisms may be used in a wide variety of applications, including computer printers, plotters, copiers, and facsimile machines. For convenience, the concepts of the invention are discussed in the context of a printer.

Color ink jet printers generally use cyan, magenta, and yellow inks to generate a full range of colors in a printed image. Black ink is used to generate portions of the output containing text and other black images, and to enhance the appearance of color image tones. While equal proportions of the three color inks may be used to create gray or black tones, it is sometimes preferable to use black ink to provide improved output appearance, reduced printing cost, and increased printing speed. In existing designs, the color cartridge typically has three short elongated arrays of nozzles, one for each color, while the black cartridge has a single, much longer high resolution array, permitting faster printing rates when no color is present.

Glossy material is often used as a printer media. Plastic film may be used for overhead projector slide transparencies, and plastic coated paper may be used to generate optimum color image quality for images having a nearly photographic appearance. Other films and foils may be used for various applications. Glossy media normally has a surface that admits little or no penetration of liquid inks. The surface tension of may inks is normally controlled to avoid unwanted "beading up" on the When printing color images that include black portions, the different inks may interact with each other to generate unwanted image defects.

Color and black inks are often selected to have different but compatible characteristics that avoid most undesirable interactions. These characteristics include rate of penetration, density of pigmentation, dry time, and water fastness. Inks may be formulated to avoid halo, but these formulations may compromise other important ink characteristics. Existing printing techniques to minimize halo include printing with additional overlapping multiple passes of partial density, heating of the print media, and/or pausing to facilitate drying between printing passes. These approaches are more expensive, or undesirably reduce printing speed.

The apparatus and method disclosed herein overcomes the above disadvantages by providing a method of processing print data by scanning the print data to determine a black density level and a color density level. A fortification function in which color density varies with respect to black density is applied, and if the color density level is less than a predetermined value based on the fortification function at the given black density level, the color density level is increased to the predetermined value. The method of processing may be performed in conjunction with the process of printing by an ink jet printer, and the fortification function may provide a color density of zero below a first threshold of black density, an increasing density up to a second threshold, and a constant density above the second threshold of black density.

BRIEF DESCRIPTION OF THE DRAWINGS

FIG. 2 is a graph of exemplary print data in a raw form.

FIG. 3 is a graph of print data after processing according to the present invention.

DETAILED DESCRIPTION OF A PREFERRED EMBODIMENT

Figure 1:
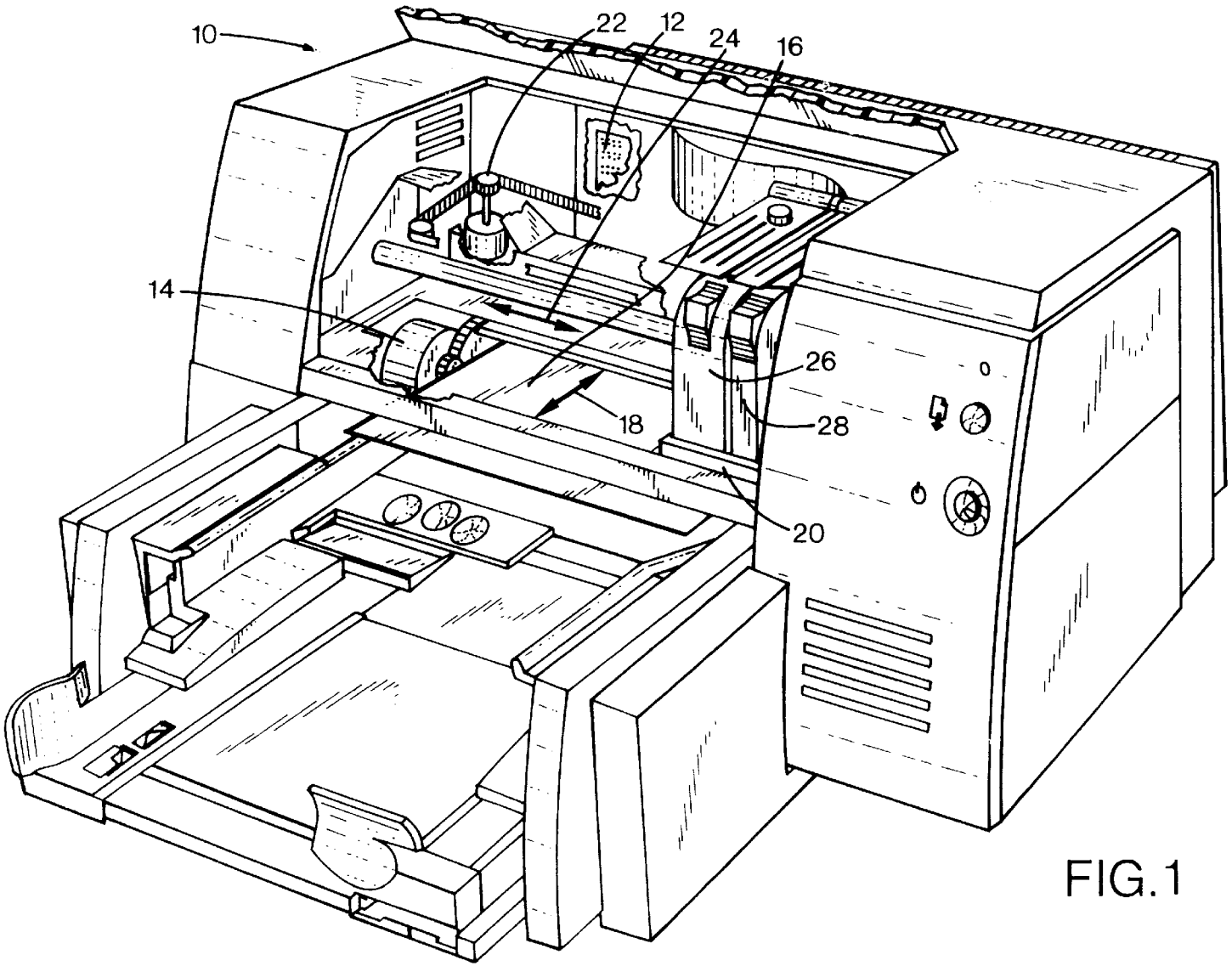
FIG. 1 is an isometric cutaway view of a printer according to the present invention.

FIG. 1 shows an ink jet printer 10 operable for performing printing according to the present invention. The printer includes a controller 12 that is connected to receive print data from an external source, and convert the print data from a raw image format to a half tone image consisting of instructions as to which pixels are to be printed with which ink colors. The controller is connected to operate an advance mechanism 14. The advance mechanism engages a media sheet 16 and moves it along an advance axis 18 during printing. A carriage 20 is mounted to a scan mechanism 22 that is connected to the controller for reciprocation of the carriage over the sheet 16 along a scan axis 24 perpendicular to the advance axis 18. A color ink cartridge 26 and a black ink cartridge 28 are mounted to the carriage. Each of the cartridges includes a print head on its lower surface for expelling ink droplets onto the sheet.

Operation

In the preferred embodiment, the controller 12 receives data from a data source such as a personal computer in a raw format such as illustrated in FIG. 2. Image data may be received in pages corresponding to the pages to be printed. These pages may include a number of objects of various types defined by how they will be printed by an ink jet printing mechanism having black and color inks. For example, a "true black" object such as text is printed only with black ink; a "business graphics" object including solid portions and halftone colors and gray scale may be printed with black ink in addition to color ink; a "photographic" object is printed with combinations of black and color ink. In the preferred embodiment, only business graphics and photographic objects arc processed.

Each object in an image comprises a matrix of logical pixels, each corresponding to the smallest unit displayed on a computer display screen. These may be defined in terms of luminance/chroma, RGB (red, blue, and green primary colors of light), or CMY (cyan, magenta, and yellow primary colors of pigment.) In this illustration, the CMY system is used, although the others may be substituted with a simple conversion. For each logical pixel, the controller receives or scans the raw data, which includes a percentage value for each of the CMY colors.

FIG. 2 shows a raw data graph 30 having three pigment bars 32, 34, 36 labeled C, M, and Y respectively. Each bar has a height corresponding to the percentage of available pigment required in the pixel. In illustrated example, cyan is 100%, magenta is 80%, and yellow is 70%, providing a dark, muted, greenish shade of blue-gray based on the subtractive properties of pigment in the CYM system. It is possible to generate a printed pixel based on the FIG. 2 logical pixel simply by printing proportionate amounts of the three ink colors in a small region. However, this consumes color ink at a relatively high rate, and only provides benefits in limited circumstances. Black ink often generates black or grayish areas more efficiently and aesthetically than a mix of the three colors. When a business graphics object includes substantial black or gray areas, it is preferred to substitute black for as much color as possible.

For each pixel, the controller determines the value of the least of the three colors. In this case, the least value is the 70% yellow, which is indicated as a least color value magnitude line 40. The controller then subtracts this least color value from each of the colors, and adds a black ink value of a magnitude equal to the least color value magnitude 40, yielding the converted pixel diagram 42 shown in FIG. 3. The FIG. 3 diagram includes a black ink column labeled K in addition to the three color columns. As converted, a cyan bar 44 shows a resulting 30% magnitude, and a magenta bar 46 shows a resulting 10% magnitude. There is no remaining data for yellow, the least magnitude color of the raw data, and a black bar 48 reflects the added black ink level of 70%. Essentially, black data as it would have been generated by equal amounts of color pigment has been replaced by an equivalent amount of black data to be produced efficiently by black ink.

Color Fortification Process

Figure 4:
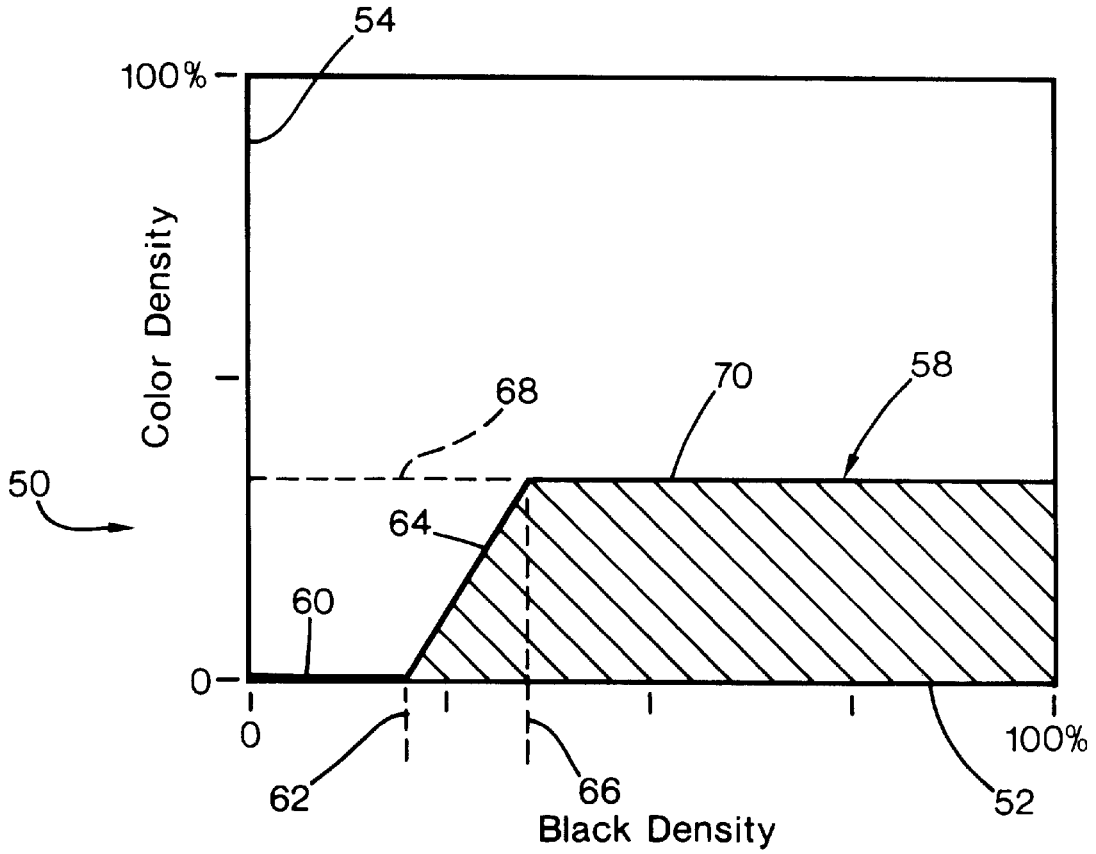
FIG. 4 is a graph illustrating an exemplary fortification function according to the present invention.
Figure 5:
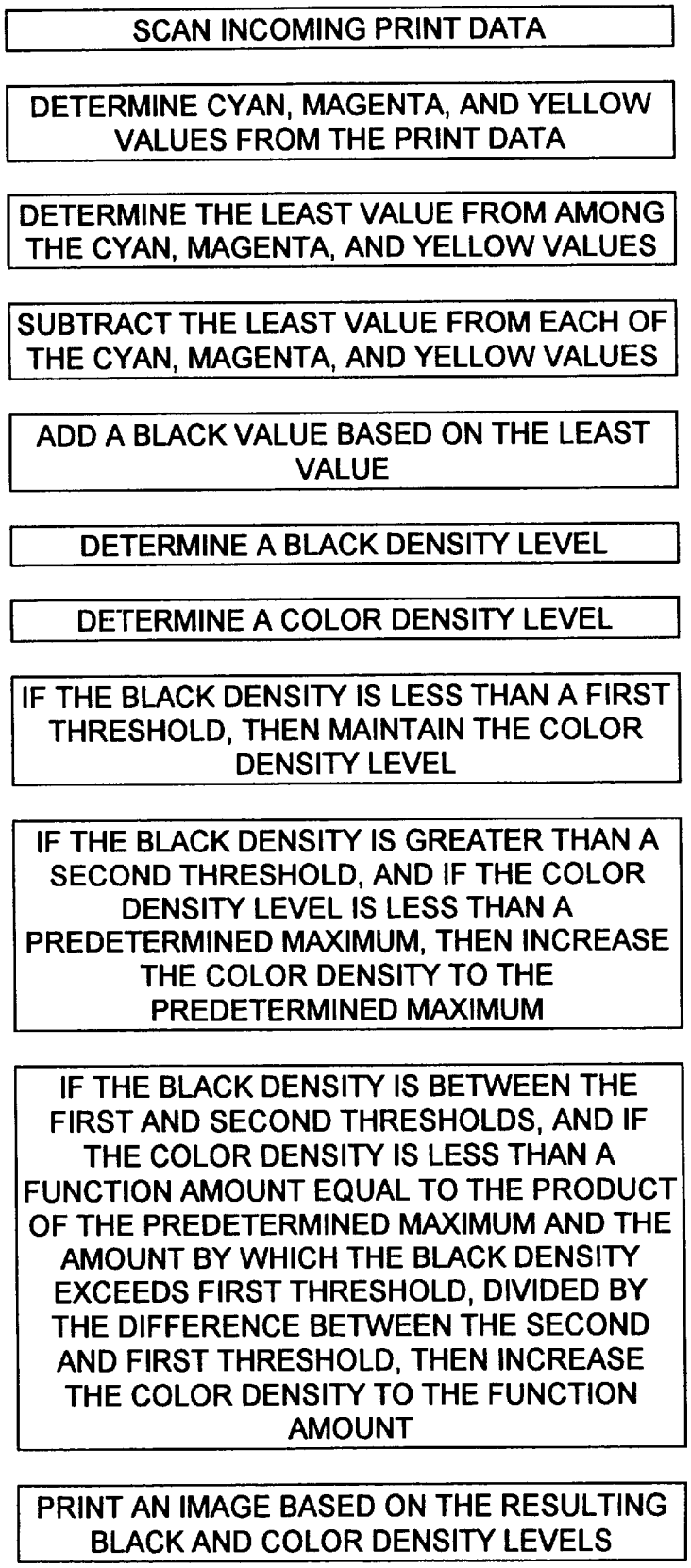
FIG. 5 is a flow chart illustrating operation of the invention according to a preferred embodiment.

When color regions abut black, dark gray, or dark grayish color regions, halo artifacts may become visible where there is insufficient color ink included in the dark region. To avoid halo, color levels may be increased where needed to generate sufficient color ink printing. The amount of color fortification required to eliminate or to satisfactorily reduce halo in a given sub region or pixel depends on the darkness of that sub region. FIG. 4 shows a fortification plot 50 with an X axis 52 indicating a range of possible black density levels of a pixel. This corresponds to the 0–100% range through which the black level 48 of FIG. 3 may vary. The fortification plot 50 has a Y axis 54 indicating a range of possible color densities levels. Color density is given in terms of the average of the magnitudes of the color bars 44, 46 in the converted data of FIG. 3.

A fortification function line 58 indicates the minimum color density level required to avoid halo for each given black density level. The function line includes three continuous segments. A first segment 60 extends horizontally within the domain between 0% black density and a first threshold black density level 62. The entire first segment has a color density level of zero, meaning that no fortification is required; halo does not occur at these low black density levels. In this domain, the converted data remains unmodified before printing.

The fortification function line 58 includes a second segment 64 within the black density domain between the first threshold black density level 62 and a greater second threshold black density level 66. The second segment 64 is a straight sloping line having a zero color density value at the first threshold 62, and reaching a predetermined positive color density level 68 (preferably 33%) at the second threshold level. Although the second segment is a straight line, the function may be selected to provide another continuous transition, but with a different shape. The shape may be a curve that is concave upward or downward, or include portions of both. It may include a series of different straight or curved segments in sequence, and may include curves that are tangent to the horizontal where they join the first or third segments in the manner of a partially or entirely differentiable function. Mathematically, the second segment may be expressed as:

$$\text{Color density} = (\text{max. predet. color density}) \times \frac{(\text{Black density} - \text{1st threshold})}{(\text{2nd threshold} - \text{1st threshold})}$$

The fortification function line 58 includes a third segment 70 within the black density domain between the second threshold black density level 66 and 100% black density. The third segment 70 is a straight horizontal line at a constant color density value of the predetermined color density level 68. This predetermined level 68 is the maximum fortification required to correct halo in black regions, and in the preferred embodiment is 33%. The mathematical formula for the third segment may be given as: $y=f(x)$ from $x_2$ to $100\%=y_{max}$.

The second threshold value 66 is at a limited logical black density value that, when printed, will generated full or nearly full black ink coverage. This effect is due to the spreading and controlled bleeding of black ink droplets on the printable surface. In a preferred embodiment printer generating black droplets at 600 dots per inch (dpi) (23.6 dots/mm), the second threshold is 35% black density. In an alternative embodiment printer generating black droplets at 600 dpi (23.6 dots/mm) on one axis and 300 dpi (11.8 dots/mm) on the other axis, the second threshold is 60% black density. It is contemplated that some printing embodiments may have a second threshold value of up to 100%.

The first threshold value 62 is at a limited logical black density less than the second threshold value 66. It is selected at the gray value at which halo begins to appear when abutting a color region. In a preferred embodiment printer printing black droplets at 600 dots per inch (dpi) (23.6 dots/mm), the first threshold is 20% black density. In an alternative embodiment printer printing black droplets at 600 dpi (23.6 dots/mm) on one axis and 300 dpi (11.8 dots/mm) on the other axis, the first threshold is 35% black density. It is contemplated that some printing embodiments may have a first threshold value from zero to less than 100% black density, and less than the second threshold.

The fortification function line 58 is continuous, without breaks or steps within or between the segments. This prevents detectable image artifacts that might otherwise be caused by sharp transitions in the added color. A critical usage would be a gradient of gray tones between light gray and black. Because the second segment is sloped to connect the first and second segments, the color fortification is added gradually, so that the gradient transition might be so smooth as to be visually unnoticeable.

If a pixel, given its black density level, contains less color density than the fortification function requires, color is added. Referring to FIG. 3, the color type to be added is determined by the color data in the converted data. Added color will be equal parts of the two colors in the converted data (in the example: cyan and magenta.) If only one color is present, then the present color and the preferred one of the others is added, based on a preference hierarchy of cyan, magenta, and yellow. The hierarchy is selected based on printing sequence and color characteristics. If there is no color data, as in the case of a gray or black pixel, the two preferred colors, cyan and magenta, are added. The quantity of each color added is equal to the amount by which the result of the fortification function exceeds half the sum of all color levels present in the converted data.

In the illustrated example, the black density of 70% black is above the second threshold 66 of 35% black, so that the fortification function yields a color density of the predetermined color density level 68 of 33% color. The average, or half the sum of the color bar levels 44, 46 is (30%+10%)/2=20%. This falls short of the required color density by 13%. Consequently, 13% is added to each of the cyan and color bars, yielding a fortified cyan value 74 of 43%, and a fortified magenta value of 23%.

Although the preferred embodiment employs the fortification algorithm in all appropriate zones based on the characteristics of each pixel, the function may be limited to instances only when a black or dark grayish object abuts a color object to conserve color ink. While the invention is described in terms of preferred embodiments, the following claims are not intended to be so limited.

I claim:

1. A method of operating an ink jet printing mechanism to process print data including at least a first color value having a first magnitude and representing a plurality of image portions, said method comprises the steps of:

scanning the print data;

for an image portion of the data, determining a black density level;

for the image portion of the data, determining a color density level;

for the image portion of the data, evaluating if the color density level is less than a predetermined value based on the black density level of the image portion;

if the color density level of the image portion is less than the predetermined value, then increasing the color density level to at least the predetermined value, including increasing the first magnitude for the image portion.

2. The method of claim 1 wherein the predetermined value is zero when the black density level is less than a predetermined first threshold.

3. The method of claim 1 wherein the predetermined value is a preselected constant when the black density level is greater than a predetermined second threshold.

4. The method of claim 3 wherein the preselected constant is between 25% and 50% color density.

5. The method of claim 3 wherein the predetermined second threshold is less than 100%.

6. The method of claim 1 wherein the predetermined value increases from zero to a preselected amount when the black density level increases from a first threshold to a greater second threshold.

7. The method of claim 1 wherein the color density is proportional to black density when the black density level increases from a first threshold to a greater second threshold.

8. The method of claim 7 wherein the predetermined value is a preselected constant when the black density level is greater than the second threshold.

9. A method of operating an ink jet printing mechanism having a black ink supply and a color ink supply having a plurality of different color inks, said method comprises the steps of:

receiving print data including at least a first color value having a first magnitude from a data source;

scanning the print data;

for an image portion of the data, determining a black density level;

for the image portion of the data, determining a color density level;

for the image portion of the data, evaluating if the color density level is less than a predetermined value based on the black density level of the image portion;

if the color density level of the image portion is less than the predetermined value, then modifying the print data by increasing the color density level to at least the predetermined value, including increasing the first magnitude for the image portion; and after modifying the print data, based on the modified print data, printing color and black ink to a printable surface.

10. The method of claim 9 wherein the predetermined value is zero when the black density level is less than a predetermined first threshold.

11. The method of claim 9 wherein the predetermined value is a preselected constant when the black density level is greater than a predetermined second threshold.

12. The method of claim 9 wherein the predetermined value increases from zero to a preselected constant when the black density level increases from a first threshold to a greater second threshold.

13. The method of claim 9 wherein the color density is proportional to black density when the black density level increases from a first threshold to a greater second threshold.

14. The method of claim 13 wherein the predetermined value is a preselected constant when the black density level is greater than the greater second threshold.

15. The method of claim 9 wherein the steps of determining density levels and modifying the print data include:

determining cyan, magenta, and yellow values from the print data;

determining the least value from among the cyan, magenta, and yellow values;

subtracting the least value from each of the cyan, magenta, and yellow values, such that at most only the two greater of the color values remain non zero;

adding a black value based on the least value, such that density lost in the subtracting step is compensated for; and wherein increasing the color density level includes adding to at least one of the greater color values.

16. A printing system that prints on a printable surface based on print data, the system comprising:

a controller;

a printable surface advance mechanism in communication with the controller;

a carriage scanning assembly in communication with the controller;

a print head connected to the carriage scanning assembly and in communication with the controller; and the controller being programmed to:

scan incoming print data;

for an image portion of the data, determine a black density level;

for the image portion of the data, determine a color density level;

for the image portion of the data, evaluate if the color density level is less than a predetermined value based the black density level of the image portion;

if the color density level of the image portion is less than the predetermined value, then increase the color density level to at least the predetermined value; and the controller being programmed to:

determine cyan, magenta, and yellow values from the print data;

determine the least value from among the cyan, magenta, and yellow values;

subtract the least value from each of the cyan, magenta, and yellow values, such that at most only the two greater of the color values remain non zero;

add a black value based on the least value; and add to at least one of the greater color values to reach the predetermined value.

17. A printing system that prints on a printable surface based on print data, the system comprising:

a controller;

a printable surface advance mechanism in communication with the controller;

a carriage scanning assembly in communication with the controller;

a print head connected to the carriage scanning assembly and in communication with the controller; and the controller being programmed to:

scan incoming print data;

for an image portion of the data, determine a black density level;

for the image portion of the data, determine a color density level;

for the image portion of the data evaluate if the color density level is less than a predetermined value based on the black density level of the image portion;

if the color density level of the image portion is less than the predetermined value, then increase the color density level to at least the predetermined value; and the controller being further programmed to:

employ a function such that:

the predetermined value is zero when the black density is less than a first threshold level;

the predetermined value is a direct function of black density when the black density is greater than the first threshold level and less than a greater second threshold level; and the predetermined value is constant when the black density is greater than the second threshold level.

* * * * *

UNITED STATES PATENT AND TRADEMARK OFFICE

CERTIFICATE OF CORRECTION

PATENT NO. : 5.959,645
DATED : September 28, 1999
INVENTOR(S) : Jay S. Gondek

It is certified that error appears in the above-identified patent and that said Letters Patent is hereby corrected as shown below:

Title page
Item [54] and Column 1,
Lines 1-2, title should read as follows:

--METHOD OF INK JET PRINTING USING COLOR FORTIFICATION IN GRAY SCALE REGIONS--

Signed and Sealed this

Second Day of October, 2001

*Attest:*

Nicholas P. Godici

*Attesting Officer*

NICHOLAS P. GODICI
*Acting Director of the United States Patent and Trademark Office*